United States Patent [19]

Fukushima et al.

[11] 4,398,187

[45] Aug. 9, 1983

[54] PRESSURE MONITORING SYSTEM FOR A VACUUM CIRCUIT INTERRUPTER

[75] Inventors: Tomio Fukushima, Higashimine; Shuzo Tanigaki, Tokyo, both of Japan

[73] Assignee: Kabushiki Kaisha Meidensha, Tokyo, Japan

[21] Appl. No.: 267,331

[22] Filed: May 26, 1981

[30] Foreign Application Priority Data

May 27, 1980 [JP] Japan ..... 55-70330

[51] Int. Cl.[3] ..... G08B 21/00

[52] U.S. Cl. ..... 340/626; 340/638; 340/660; 361/120

[58] Field of Search ..... 340/626, 660, 638; 361/120; 200/144 B; 350/374

[56] References Cited

U.S. PATENT DOCUMENTS

| | | | |
|---|---|---|---|
| 3,403,297 | 9/1968 | Crouch | 361/120 |
| 3,594,754 | 7/1971 | Voshall | 340/626 |
| 3,744,045 | 7/1973 | Frink et al. | 340/660 |
| 4,034,264 | 7/1977 | Muller et al. | 340/638 |
| 4,096,366 | 6/1978 | Titus | 361/120 |
| 4,103,291 | 6/1978 | Howe et al. . | |
| 4,163,130 | 7/1970 | Kubota et al. . | |

*Primary Examiner*—Gerald L. Brigance

*Attorney, Agent, or Firm*—Lowe, King, Price & Becker

[57] ABSTRACT

A pressure monitoring system for a high-voltage vacuum circuit interrupter including a plurality of capacitors connected in series located outside an evacuated housing and between two metallic end plates each attached to the electrode holder and an arc shielding member. The pressure monitoring system which monitors the deterioration of vacuum pressure within the evacuated housing of the interrupter by detecting the change in the electric field intensity of the capacitors dependent upon the change in vacuum pressure comprises a light source, at least one electric field detecting member having a Pockel's cell located on one of the capacitors, light receiving member and a vacuum pressure determining member, whereby an automatic monitoring of vacuum pressure within the evacuated housing of the vacuum circuit interrupter or within each of the evacuated envelopes of a plurality of vacuum circuit interrupters can be made.

19 Claims, 9 Drawing Figures

PRESSURE MONITORING SYSTEM FOR A VACUUM CIRCUIT INTERRUPTER

BACKGROUND OF THE INVENTION (1) Field of the Invention

The present invention relates generally to a pressure monitoring system for a vacuum circuit interrupter, and particularly to a pressure monitoring system using an optical device to detect the change in vacuum pressure within an evacuated envelope of a high-voltage vacuum circuit interrupter having a plurality of capacitors connected in series with one another, the whole group of capacitors being connected in parallel with the vacuum circuit interrupter, located outside the evacuated envelope to divide the voltage applied to the interrupter equally between each capacitor.

(2) Description of the Prior Art

In general, it is necessary to monitor vacuum pressure within a vacuum related electrical apparatus such as a vacuum circuit interrupter since the performance of such a vacuum circuit interrupter depends on whether the degree of vacuum pressure within an evacuated envelope is lower than $10^{-4}$ Torr as indicated in column 1 lines 11–13 of U.S. Pat. No. 4,034,264.

The prior art of the pressure monitoring system is briefly described hereinafter. The pressure monitoring system for such a vacuum circuit interrupter is already proposed by the applicant in Japan patent application No. 55-37098. The disclosed pressure monitoring system comprises a light source, a polarizer for linearly polarizing the light from the light source, an electric field detecting element such as a Pockel's cell utilizing the Pockel's effect that changes the angle of the polarization plane with respect to that of the incident light from the polarizer according to the electric field intensity applied thereto thus changing in response to vacuum pressure within the vacuum circuit interrupter, an analyzer having its polarization plane in a predetermined relationship with that of the polarizer, for receiving the light from the Pockel's cell, and a light receiving member for receiving the light incident from the analyzer and photoelectrically converting it into an electrical signal.

When the pressure monitoring system of the type described above is installed in the vicinity of the vacuum circuit interrupter, the deterioration of vacuum pressure can be monitored without electrically touching the interrupter since vacuum pressure within the vacuum circuit interrupter is substantially proportional to the electric field intensity in the vicinity of the vacuum circuit interrupter (that is, in the space near the outside of the evacuated envelope of the vacuum circuit interrupter where the electric field intensity changes with vacuum pressure).

High-voltage large-sized vacuum circuit interrupters are provided with a plurality of capacitors in series between an end plate connected to a stationary electrode holder supporting a stationary electrode contact, an arc shielding member, and another end plate connected to a movable electrode holder. These capacitors are used to divide the voltage applied to the electrode contacts equally between each capacitor so that the interruption performance can be improved.

Conventionally, the monitoring of vacuum pressure in the vacuum circuit interrupter of the type as described above needs to be performed after modifying the construction of the vacuum circuit interrupter of the type where the capacitors are connected in parallel therewith so as to detect vacuum pressure therein.

SUMMARY OF THE INVENTION

With the above-described problem in mind, it is an object of the present invention to provide a pressure monitoring system for a high-voltage vacuum circuit interrupter having a stationary electrode holder extending through a stationary end plate into an evacuated envelope and having a stationary electrode contact at the end thereof, a movable electrode holder extending through a movable end plate into the evacuated envelope and having a movable electrode contact at the end thereof, an arc shielding member surrounding both electrode contacts so as to prevent arcing products from impinging on the envelope when the contacts are separated to open the power supply circuit of the vacuum circuit interrupter, and a plurality of capacitors in cascade connection located outside the evacuated envelope between the stationary end plate and arc shielding member and between the arc shielding member and the movable end plate.

To achieve the present invention, the pressure monitoring system of the construction described hereinbefore is installed in parallel with one of the capacitors or in series with the remaining capacitors in place of one of the capacitors without directly contacting the interrupter electrically. When a plurality of vaccum circuit interrupters are integrally monitored by means of the pressure monitoring system, each electric field detecting member is installed on one of the capacitors connected to one of the vacuum circuit interrupters, whereby the pressure monitoring system can indicate that pressure within any one of the vaccum circuit interrupters has increased. Therefore, the present invention enables performance of an automatic monitoring of vacuum pressure within the evacuated envelope of the vacuum circuit interrupter.

DESCRIPTION OF THE DRAWINGS

The features and advantages of the pressure monitoring system of the vacuum circuit interrupter(s) will be better appreciated from the following description taken in conjunction with the accompanying drawings in which like reference numerals designate corresponding elements, and in which.

DESCRIPTION OF THE PREFERRED EMBODIMENTS

Figure 1:
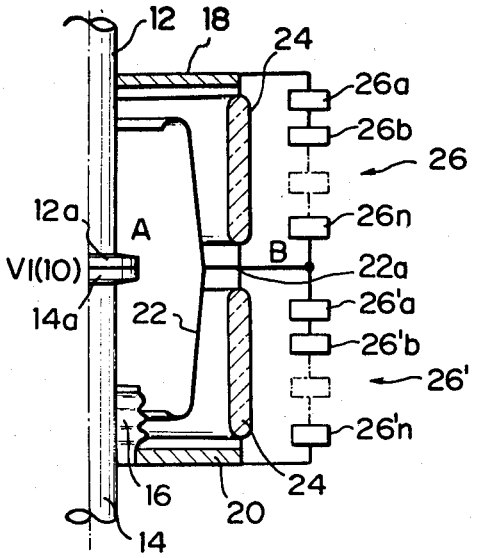
FIG. 1 illustrates a cross-sectioned partial side view of a high-voltage vacuum circuit interrupter.

Reference will be now made to the drawings, and first to FIG. 1 which illustrates a typical example of a high-voltage vacuum circuit interrupter to which a plurality of voltage-dividing capacitors are attached.

In FIG. 1, a vacuum circuit interrupter abbreviated as VI comprises a highly evacuated housing 10. This housing 10 comprises a stationary metallic end plate 18 and a movable metallic end plate 20. These metallic end plates are located at opposite ends of the housing 10. A stationary electrode holder 12 extending through the stationary metallic end plate 18 is provided with a stationary electrode contact 12*a* at the extended end thereof defining an electrode member 12, 12*a*. A movable electrode holder 14 extending through the movable end plate 20 is provided with a movable electrode contact 14*a* at the extended end thereof defining an electrode member 14, 14*a*. The movable electrode holder 14 is vertically movable to effect the opening and closing of the vacuum circuit interrupter VI. Thus, the movable electrode contact 14*a* is separated from or in contact with the stationary electrode contact 12*a*.

To permit the vertical movement of the movable electrode holder 14 without impairing the vacuum inside the housing 10, a suitable bellows 16 is provided around the movable electrode holder 14. A metallic arc shielding member 22 surrounds the stationary and movable electrode contacts 12*a* and 14*a* to protect the inner surface of insulating envelopes 24 from being bombarded by arcing products. The vacuum circuit interrupter VI is operated by driving the movable electrode contact 14*a* upward or downward to close or open the power supply circuit applied thereto. When these contacts 12*a* and 14*a* are in contact with each other, a current can flow between the opposite ends of the vacuum circuit interrupter VI via the path of the movable electrode holder 14, the movable electrode contact 14*a*, the stationary electrode contact 12*a*, and the stationary electrode holder 12.

Circuit interrupting is effected by forcing the contact 14*a* to move downward from the closed position by means of a suitable actuating mechanism (not shown in this drawing). This downward movement often causes an arc between the contacts 12*a* and 14*a*. If it is an alternating current circuit that is broken, the arc persists until about the time when a natural current zero is reached, at which time it extinguishes and is thereafter prevented from reigniting due to the high dielectric strength of the vacuum. A typical arc is formed during the circuit interrupting operation. To protect the inner surface of insulating envelope 24 from metallic vapors, the arc shielding member 22 is supported on the tubular insulating envelopes 24 by means of an annular metallic disc 22*a* attached to the arc shielding member 22 and attached to a pair of annular insulating envelopes 24, e.g., made of glass.

In addition, a plurality of capacitors connected in series 26*a*, 26*b*, . . . , 26*n* and 26'*a*, 26'*b*, . . . , 26'*n* are usually provided in the vicinity of the pair of insulating envelopes 24 between the stationary end plate 18 and the metallic disc 22*a* and between the metallic disc 22*a* and the movable end plate 20, respectively, in the high-voltage vacuum circuit interrupter VI. These capacitors 26*a*, 26*b*, . . . 26*n* and 26'*a*, 26'*b*, . . . 26'*n*, connected in series, are provided to divide the voltage applied between the contacts 12*a* and 14*a* equally among each capacitor between the stationary electrode contact 12*a*, the movable electrode contact 14*a*, and the arc shielding member 22. The number of these capacitors mainly depends on the voltage range to be handled by such a vacuum circuit interrupter.

Figure 2:
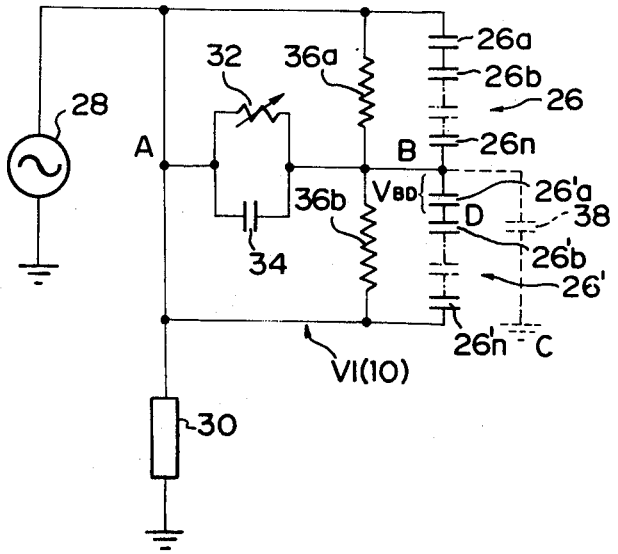
FIG. 2 illustrates an equivalent circuit of the vacuum circuit interrupter in the closed position having a plurality of voltage-dividing capacitors shown in FIG. 1.

FIG. 2 illustrates an equivalent circuit of the vacuum circuit interrupter VI shown by FIG. 1 during the time when the vacuum circuit interrupter is closed.

As can be appreciated from FIG. 2, the voltage from a commercial power supply 28 is closed or opened by the vacuum circuit interrupter VI. A variable resistor 32 represents the leak resistance between the stationary and movable electrode members 12, 12*a* and 14, 14*a*, and the arc shielding member 22. A capacitor 34 represents the stray capacitance between these electrode members 12, 12*a* and 14, 14*a* and the arc shielding member 22. Two fixed resistors 36*a* and 36*b* represent the insulating resistances between the stationary end plate 18 and the annular metallic disc 22*a* and between the movable end plate 20 and the metallic disc 22*a* through the pair of insulating envelopes 24. A capacitor 38 shown by dotted lines indicates the stray capacitance between the arc shielding member 22 and ground.

Although the capacitances 34 and 38 between the stationary and movable electrode members 12, 12*a* and 14, 14*a* and ground are constant regardless of vacuum pressure (since the permittivity of air $\epsilon$ is substantially equal to that of a vacuum $\epsilon_o$), the resistance 32 between the electrode members 12, 12*a* and 14, 14*a* and the arc shielding member 22, varies according to changes in vacuum pressure. It will be seen that the commercial power supply 28 is connected to a load 30 to supply a voltage thereto.

Furthermore, the plural capacitors 26*a* to 26*n* and 26'*a* to 26'*n* are provided between stationary and movable end plates 18 and 20 respectively and the annular metallic discs 22*a* of the arc shielding member 22. If the insulating resistances 36*a* and 36*b* are equal, the voltage of the power supply 28 is substantially divided equally between the two capacitor groups 26 and 26'.

When pressure within the vacuum envelope is maintained lower than $10^{-4}$ Torr as described hereinabove, the voltage between parts A and B (Part A indicating the section near the stationary and movable electrode members 12, 12*a* and 14, 14*a*, and part B indicating the section near the metallic disc 22*a*) is constant and substantially high. When pressure within the vacuum envelope is increased and, accordingly, discharging of arc current starts, the voltage allotted between points B and C increases (point C indicating ground, i.e., zero voltage).

Hence, it will be appreciated that a voltage $V_{BD}$ allotted to one of the capacitors 26*a* to 26*n* or 26'*a* to 26'n, connected in parallel with the vacuum circuit interrupter VI, is increased according to increasing vacuum pressure.

This relationship holds effectively not only in the closed state but also in the opened state of the vacuum circuit interrupter. The monitoring of vacuum pressure can be performed through detection of the changes in the voltage $V_{BD}$ across any one of the capacitors 26a to 26n or 26'a to 26'n.

Figure 3:
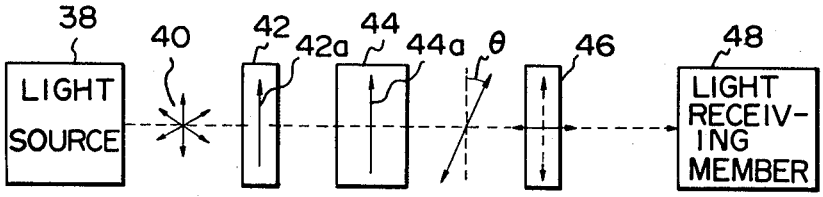
FIG. 3 illustrates a simplified block diagram of the basic construction of the pressure monitoring system to be applied to the vacuum circuit interrupter shown in FIG. 1.

FIG. 3 illustrates a basic construction of the pressure monitoring system to be applied to the high-voltage vacuum circuit interrupter VI described above.

In FIG. 3, numeral 38 denotes a light source, numeral 40 denotes unpolarized light emitting from the light source 38, numeral 42 denotes a polarizer which polarizes the light 40 from the light source 38, in the direction shown by an arrow, numeral 44 denotes a Pockel's cell utilizing the Pockel's effect of changing the angle of the polarization plane 44a of the incident light 42a from the polarizer 42 according to the change in the electric field intensity applied thereto, the electric field intensity in this case changing according to changes in vacuum pressure, numeral 46 denotes an analyzer, having a polarization plane of a predetermined angle, e.g., parallel or perpendicular with respect to that of the polarizer 42, receiving the light incident from the Pockel's cell 44, and numeral 48 denotes a light receiving member including a photoelectric converter receiving the light incident from the analyzer 46 and converting it into a predetermined electric signal, the level depending on the quantity of light from the analyzer 46.

In such a construction described above, an electric field is applied to the Pockel's cell 44 in one of two directions: parallel to the light path (longitudinal structure), or perpendicular thereto (transverse structure). Consequently, the quantity of light output from the analyzer 46 changes and the electrical signal in response to the changed quantity of light is output from the light receiving member 48.

Figure 4:
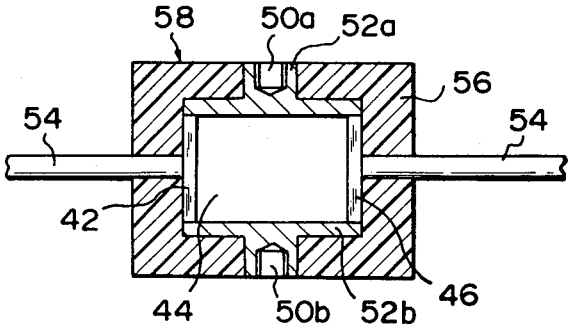
FIG. 4 illustrates a simplified sectional view of an electric field detecting member of the pressure monitoring system according to the present invention.

In FIGS. 3 and 4, an optical fiber, designated as 54 in FIG. 4, provides a means for transmitting the light from the light source 38 to the polarizer 42 and from the analyzer 46 to the light receiving member 48. If an optical fiber is not used, the polarization planes of the polarizer 42 and analyzer 46 are changed due to the fluctuations of air and the displacement of the system with respect to time so that a stable measurement and free selection of light path cannot be made.

In the construction shown in FIG. 3, since the polarization planes of the polarizer 42 and analyzer 46 are disposed parallel to each other, the quantity of light outputted from the analyzer 46 is changed as the voltage applied to the Pockel's cell 44 changes.

FIG. 4 shows an embodiment of an electric field detecting member adapted to be attached onto one of the capacitors 26a to 26'n in the transverse structure, wherein the same reference numerals designate corresponding elements. Numeral 50a and 50b denote holes provided to mount the electric field detecting member 58 in the capacitor group 26 or 26'. Numerals 52a and 52b denote a pair of electrodes facing each other sandwiching the Pockel's cell 44. Numeral 56 denotes a housing made of a synthetic resin of either the cold molding type or the thermosetting type, whereby the Pockel's cell 44 is sandwiched between the polarizer 42 and analyzer 46.

The polarizer 42 is thus tightly connected to the optical fiber 54 and the analyzer 46 is also tightly connected to the optical fiber 54, by means of a casing 58.

In addition, the pair of electrodes 52a and 52b sandwiching the Pockel's cell 44 are mounted perpendicularly with respect to the light path (transverse structure) and all elements 52a, 52b, 42, 46 and the ends of the optical fibers 54 are molded with the casing 58 made of a synthetic resin material.

Figure 5:
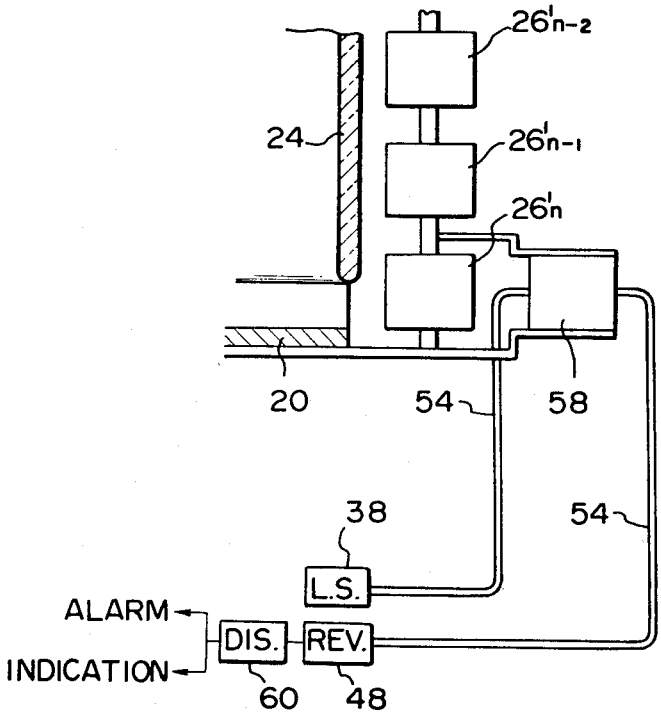
FIG. 5 illustrates a simplified partial side view of a vacuum circuit interrupter to which a plurality of voltage-dividing capacitors are attached when the electric field detecting member of the pressure monitoring system according to the present invention is connected in parallel with one of the capacitors.
Figure 6:
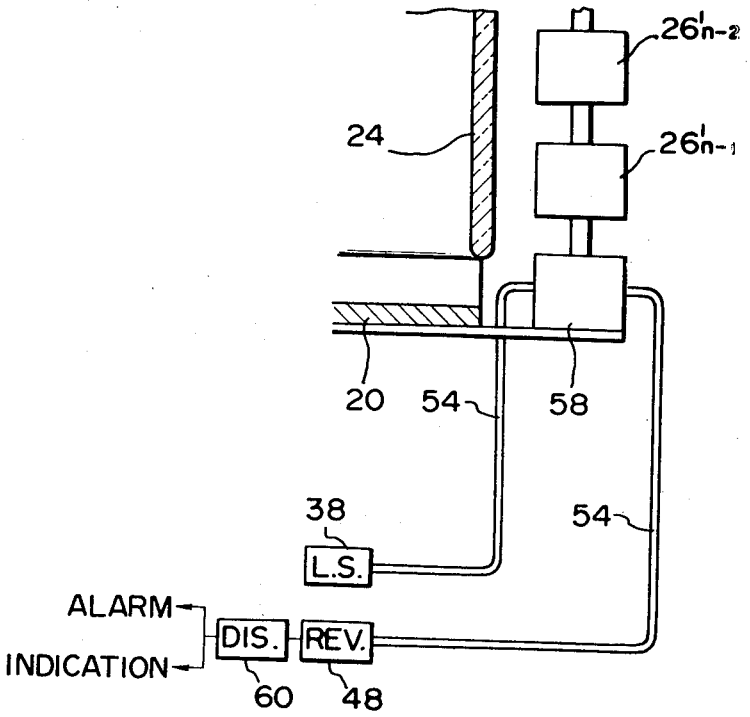
FIG. 6 illustrates a simplified partial side view of a vacuum circuit interrupter to which a plurality of the capacitors are attached when the electric field detecting member of the pressure monitoring system according to the present invention is connected in series with the remaining capacitors in place of one of the capacitors.

FIGS. 5 and 6 illustrate first and second preferred embodiments according to the present invention.

FIG. 5 illustrates a simplified configuration of the pressure monitoring system when applied to a high-voltage vacuum circuit interrupter VI as described hereinbefore. As shown in FIG. 5, the casing of the electric field detecting member 58 is connected in parallel with one of the capacitors 26'n between the metallic disc 22a of the arc shielding member 22 and the movable end plate 20. In this configuration, the ratio between the capacitance of the voltage dividing capacitor 26'n and the electrostatic capacity of the field detecting member 58 is selected so as to given optimum value on a basis of the relationship between the voltage applied to the field detecting member 58, i.e., the voltage across the capacitor 26'n and the dielectric strength of the field detecting member 58. Light receiving member 48 converts the light incident from field detecting member 58 into an electrical output, and a vacuum pressure discriminating member 60 detects the vacuum pressure by the electrical output of the light receiving member 48.

FIG. 6 illustrates another simplified configuration of the pressure monitoring system when applied to the high-voltage vacuum circuit interrupter VI as indicated in FIG. 1.

As shown in FIG. 6, the casing of the electric field detecting member 58 is connected in place of one of the capacitors 26'n in series with the other series-connected voltage dividing capacitors 26'a to 26'n-1. In this case, the electrostatic capacity of the field detecting member casing 58 is selected in substantially the same way as that shown in FIG. 5.

Figure 7:
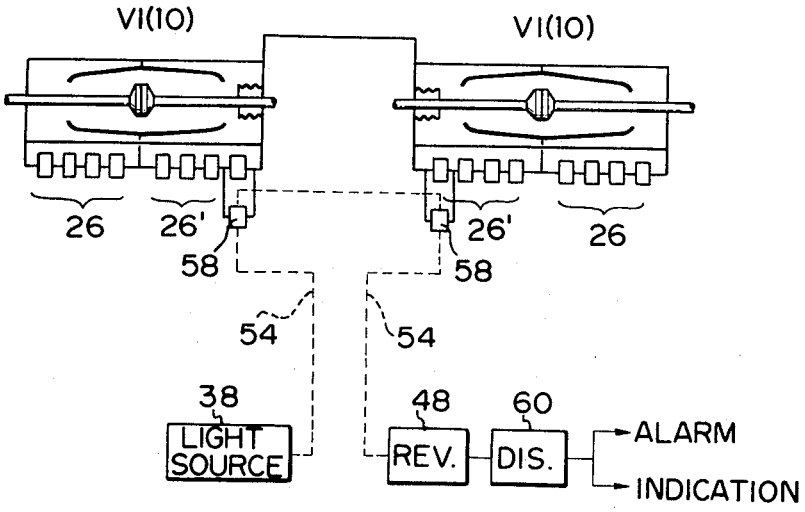
FIG. 7 illustrates a simplified overall view of the pressure monitoring system when applied to two vacuum circuit interrupters connected in series in a single-phase power supply line.

FIG. 7 illustrates a third preferred embodiment according to the present invention in a case where a single pressure monitoring system simultaneously monitors vacuum pressure within each of a plurality of vacuum circuit interrupters connected in series.

In FIG. 7, two vacuum circuit interrupters VI (10) are connected in series in a single-phase power supply line, and two field detecting member casings 58 are connected in series along the optical fiber 54.

In this case, the polarization planes of the polarizer 42 and analyzer 46 are set to coincide with each other. In addition, each field detecting member casing 58 is connected in parallel with one of the capacitors 26' attached to each of the two vacuum circuit interrupters VI(10). As described hereinbefore, each field detecting member 58 may be connected in series with the other remaining capacitors 26 and 26' in place of one of the capacitors 26 and 26' as described with reference to FIG. 6.

In the first, second, and third preferred embodiments according to the present invention shown by FIGS. 5, 6, and 7, the field detecting member 58 detects and signals the change in the electric field intensity according to increasing vacuum pressure, and the light receiving member 48, including the photoelectric converter, converts the light incident from the field detecting member 58 into an electrical output. Vacuum pressure discriminating member 60 connected to the light receiving member 48 detects vacuum pressure by the electrical output of the light receiving member 48. Finally, the monitoring of vacuum pressure is completed by the addition of some form of alarm or indication on the basis of the monitored result.

Figure 8:
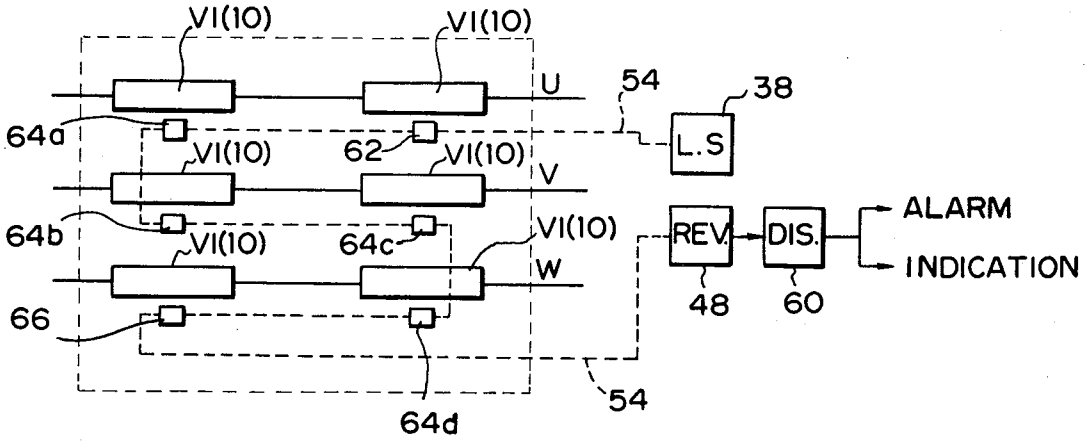
FIG. 8 illustrates a simplified block diagram of the pressure monitoring system when applied to a three-phase vacuum circuit interrupter comprising two vacuum circuit interrupting units in each of the three-phase power supply lines.

FIG. 8 illustrates a fourth preferred embodiment according to the present invention when the pressure monitoring system is applied to a three-phase vacuum circuit interupter. The three-phase vacuum circuit interrupter shown in FIG. 8 comprises six vacuum circuit interrupting units two of which are connected in series along each of the three phase power lines denoted by U, V, and W.

Figure 9:
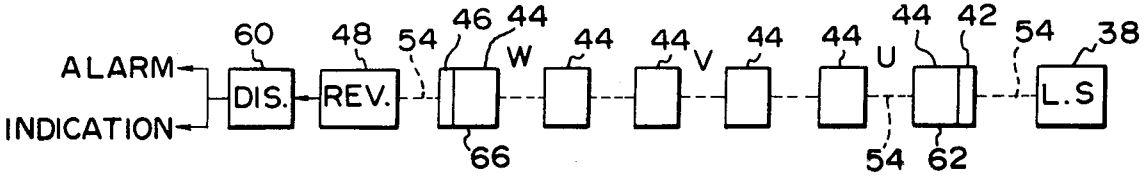
FIG. 9 illustrates a simplified block diagram of the pressure monitoring system of the fourth preferred embodiment of the invention.

FIG. 9 illustrates a simplified block diagram of the pressure monitoring system of the fourth preferred embodiment according to the present invention.

As shown in FIGS. 8 and 9, the light source 38 is connected to an input field detecting member 62 via the optical fiber 54 shown by the dotted line. The input field detecting member 62 comprises a polarizer 42 and a Pockel's cell 44. Each of the intermediate field detecting members 64*a* to 64*d* comprises a Pockel's cell 44 only. An output field detecting member 66, connected to the light receiving member 48 by the optical fiber 54, comprises a Pockel's cell 44 and an analyzer 46. It will be self-explanatory that all the dotted lines indicate the optical fiber 54.

In the fourth embodiment, both polarization planes of the polarizer 42 and analyzer 46 may be either perpendicular or parallel to each other. Furthermore, vacuum pressure can be monitored for the six vacuum circuit interrupting units simultaneously regardless of the open or closed state of each of the vacuum circuit interrupting units VI(10).

As an example of the light receiving member 48 and vacuum pressure discriminating member 60, the following circuit may be considered: a phototransistor whose output current changes with the light quantity, an amplifier outputting a voltage signal according to the current from the phototransistor and a comparator comparing the signal from the amplifier with a reference voltage representing the limit of vacuum pressure and outputting an alarm or an signal representing vacuum pressure within one of the monitored vacuum circuit interrupting units when vacuum pressure has increased, e.g., when the voltage signal from the amplifier exceeds the reference voltage or drops below the reference voltage.

The first, second, third, and fourth preferred embodiments according to the present invention have the following advantages because of the configurations between the pressure monitoring system and the vacuum circuit interrupter:

(1) Automatic monitoring of vacuum pressure can be made without structural modification of the vacuum circuit interrupter by a plurality of voltage dividing capacitors;

(2) The measurement of vacuum pressure can be made regardless of the voltage of the vacuum circuit interrupter because of the inherent electrical insulation of the electric field detecting member to be installed in the vicinity of the high-voltage vacuum circuit interrupter and of the optical fiber;

(3) Since the field detecting member has substantially the same construction as a normal high-voltage ceramic capacitor, it is very easy to mount the field detecting member on the vacuum circuit interrupter in parallel with one of the plurality of capacitors as described in the first preferred embodiment or in series with the remaining capacitors in place of one of the capacitors as described in the second prefered embodiment;

(4) Good insulation and inherent high noise immunity of the pressure monitoring system permit a highly reliable monitoring of vacuum pressure since the elements disposed in the vicinity of the vacuum circuit interrupter (i.e., the field detecting members) are all passive elements, and particularly since the adoption of the Pockel's cell allows an accurate reading of the change in vacuum pressure through photoelectric conversion;

(5) The pressure monitoring system according to the present invention permits monitoring of vacuum pressure in either the open or the closed state of the vacuum circuit interrupter;

(6) The pressure monitoring system according to the present invention is simple and economically advantageous since a plurality of vacuum circuit interrupters connected in series in a single phase power supply or in one of three-phase power lines is integrally monitored at the same time, as was described in the third and fourth preferred embodiments.

As described hereinbefore, the pressure monitoring system of a vacuum circuit interrupting device according to the present invention, which detects and signals vacuum pressure of at least one vacuum circuit interrupter having a plurality of series-connected capacitors between the end plates thereof and an arc shielding member, can perform an automatic monitoring of the vacuum pressure without directly contacting the vacuum circuit interrupter (s) electrically and without structural modification of the vacuum circuit interrupter. This advantage is possible since at least two polarizing elements intervene between the light source and the light receiving member along the optical fiber and the Pockel's cell is disposed between the polarizing elements.

In addition, the deterioration of vacuum pressure can be read reliably since vacuum pressure is converted photo-electrically.

It will be understood by those skilled in the art that the foregoing description is illustrative of the preferred embodiments, and that various changes and modifications may be made thereto without departing from the spirit and scope of the present invention, which is to be defined by the appended claims.

What is claimed is:

1. A pressure monitoring system in a vacuum circuit interrupter including:

(a) a stationary electrode holder extending through a first metallic end plate into an evacuated housing and having a stationary electrode contact at an end thereof;

(b) a movable electrode holder extending through a second metallic end plate into the evacuated housing and having a movable electrode contact at an end thereof so as to be in contact with or separated from the stationary electrode contact;

(c) an arc shielding member surrounding the stationary and movable electrode contacts within the evacuated housing spaced between the first and second metallic end plates; and (d) a plurality of capacitors located outside the evacuated housing and connected between the first metallic end plate and the arc shielding member and between the arc shielding member and the second metallic end plate for dividing the voltage, applied to both stationary and movable electrode contacts, equally among each of said capacitors, the improvement comprising:

(e) a light source;

(f) an electric field detecting member located on one of the capacitors for detecting a change in the electric field intensity within the evacuated housing dependent upon change in pressure within the evacuated housing and controlling the light from said light source according to the detected change in the electric field intensity; and (g) a light receiving member for receiving the light from said electric field detecting member and converting it into an electrical signal according to the quantity of light received from said electric field detecting member.

2. A pressure monitoring system for a vacuum circuit interrupter as set forth in claim 1, wherein the vacuum pressure monitoring system further comprises:

a vacuum pressure discriminating member for determining a change in vacuum pressure within the evacuated housing of the vacuum circuit interrupter in response to the electrical signal from said light receiving member.

3. A pressure monitoring system for a vacuum circuit interrupter as set forth in claim 1, wherein said electric field detecting member comprises an electric field detecting element for changing the angle of the plane of polarization of the incident thereupon according to the change in the electric field, an analyzer located so as to receive the light passed through said electric field detecting element for analyzing the light from said electric field detecting element, and a pair of electrodes provided so as to sandwich said electric field detecting element perpendicularly with respect to the light path thereof and so as to connect electrically with one of said capacitors.

4. A pressure monitoring system for a vacuum circuit interrupter as set forth in claim 3, wherein said light source comprises an unpolarized light source and which further comprises a polarizer located to intercept light generated by said unpolarized light source for polarizing the light transmitted from said unpolarized light source so as to provide the polarized light into said electric field detecting element.

5. A pressure monitoring system for a vacuum circuit interrupter as set forth in claim 4, which further comprises an optical fiber provided between said light source and said polarizer for securely transmitting the light from said light source to said polarizer.

6. A pressure monitoring system as set forth in claim 3, wherein the polarization plane of said analyzer coincides with that of the light incident upon said electric field detecting element.

7. A pressure monitoring system as set forth in claim 3, wherein the polarization plane of said analyzer is perpendicular with respect to that of the light incident upon said electric field detecting element.

8. A pressure monitoring system for a vacuum circuit interrupter as set forth in claim 3, wherein said electric field detecting element is a Pockel's cell.

9. A pressure monitoring system for a vacuum circuit interrupter as set forth in claim 3 further comprising an optical fiber provided between said analyzer and said light receiving member for securely transmitting the light from said analyzer to said light receiving member.

10. A pressure monitoring system for a vacuum circuit interrupter as set forth in claim 1, wherein said electric field detecting member is located in parallel with one of the plurality of the capacitors so as to detect the change in the electric field intensity across the capacitor connected in parallel therewith.

11. A pressure monitoring system for a vacuum circuit interrupter as set forth in claim 8, wherein said electric field detecting member comprises an electric field detecting element for changing the angle of the plane of polarization of the incident light thereupon according to the change in the electric field intensity within the evacuated housing, the electric field intensity changing in dependence on the change in pressure within the evacuated housing, and a pair of electrodes provided so as to sandwich said electric field detecting element perpendicularly with respect to the light path thereof and wherein said pair of electrodes sandwiching said electric field detecting element are connected in parallel with corresponding electrodes of said capacitor, an electrostatic capacitance of said electric field detecting member being selected on a basis of the voltage allotted to said capacitor, capacitance of said capacitor, and insulation strength of said electric field detecting member itself.

12. A pressure monitoring system for a vacuum circuit interrupter as set forth in claim 1, wherein said electric field detecting member is inserted in place of one of the capacitors in series with the remaining capacitors so as to detect the change in the electric field intensity thereacross.

13. A pressure monitoring system for two series connected vacuum circuit interrupters as set forth in claim 1, wherein the pressure monitoring system comprises two of said electric field detecting members located on first and second ones of the plurality of capacitors mounted on first and second ones of said two vacuum circuit interrupters, respectively, and optically connected in series with each other via an optical fiber.

14. A pressure monitoring system for a vacuum circuit interrupter as set forth in claim 13 wherein said light source comprises an unpolarized light source and further comprising a polarizer for polarizing the light transmitted from said light source so as to provide the polarized light into said electric field detecting member, said polarizer being optically connected to said light source via an optical fiber and wherein said two electric field detecting members include an analyzer optically connected to said light receiving member via another optical fiber.

15. A pressure monitoring system for a plurality of vacuum circuit interrupters as set forth in claim 1, said plurality of vacuum circuit interrupters each having substantially the same construction and forming a three-phase vacuum circuit interrupter, wherein the pressure monitoring system has a plurality of said electric field detecting members, individual electric field detecting members each being located on an individual one of the plurality of capacitors mounted on an individual one of said vacuum circuit interrupters and being optically connected to each other via an optical fiber.

16. A pressure monitoring system for a vacuum circuit interrupter as set forth in claim 15, wherein said light source comprises an unpolarized light source and further comprising a polarizer for polarizing the light transmitted from said light source to corresponding ones of said electric field detecting members, said polarizer being optically connected to said light source via an optical fiber, and wherein said plurality of electric field detecting members includes an analyzer optically connected to said light receiving member via another optical fiber.

17. A pressure monitoring system as set forth in claim 5 wherein said electric field detecting member and polarizer are integrally housed within a housing made of a resin.

18. A pressure monitoring system as set forth in claim 17 wherein said resin is a cold molding type of resin.

19. A pressure monitoring system as set forth in claim 17 wherein said resin is a thermosetting type of resin.

* * * * *